US011464279B2

(12) United States Patent
Alothmany et al.

(10) Patent No.: US 11,464,279 B2
(45) Date of Patent: Oct. 11, 2022

(54) SHOE EXTENSION FOR PATIENT GAIT MODIFICATION

(71) Applicant: King Abdulaziz University, Jeddah (SA)

(72) Inventors: Nazeeh Alothmany, Jeddah (SA); Ehab Hafiz Wali, Jeddah (SA); Abdulhameed Fouad Alkhateeb, Jeddah (SA); Umar M. Alabasi, Jeddah (SA); Mirza Pasovic, Jeddah (SA)

(73) Assignee: King Abdulaziz University, Jeddah (SA)

( * ) Notice: Subject to any disclaimer, the term of this patent is extended or adjusted under 35 U.S.C. 154(b) by 168 days.

(21) Appl. No.: 16/913,184

(22) Filed: Jun. 26, 2020

(65) Prior Publication Data

US 2021/0401111 A1 Dec. 30, 2021

(51) Int. Cl.
*A43B 3/16* (2022.01)
*A43B 7/1475* (2022.01)
(Continued)

(52) U.S. Cl.
CPC ..... *A43B 7/1475* (2013.01); *A43B 1/10* (2013.01); *A43B 3/128* (2013.01); *A43B 3/16* (2013.01);
(Continued)

(58) Field of Classification Search
CPC ..... A43B 3/16; A43B 7/00; A43B 13/223; A43C 15/02; A43C 15/12; A61H 3/00
See application file for complete search history.

(56) References Cited

U.S. PATENT DOCUMENTS 403,817 A * 5/1889 Wolfe ..... A43B 3/16 36/7.1 R
1,411,200 A * 3/1922 Zertuche ..... A43C 15/00 36/7.7
(Continued)

FOREIGN PATENT DOCUMENTS

CN 203378627 U 1/2014

OTHER PUBLICATIONS

"Evenup Shoe Balancer for Uneven Gait", Rehabmart, https://www.rehabmart.com/product/evenup-shoe-balancer-47761.html, Aug. 8, 2019, 12 pages.
(Continued)

*Primary Examiner* — Ted Kavanaugh
(74) *Attorney, Agent, or Firm* — Oblon, McClelland, Maier & Neustadt, L.L.P.

(57) ABSTRACT

A shoe extension for gait modification includes a vamp section, a base section, an attachment strap, and a restraining mechanism. The vamp section is connected to a top surface of the base section forming a receiving slot. A toe box of a shoe worn on a healthy limb is slidably positioned into the receiving slot such that the base section is positioned along an outsole of the shoe. The attachment strap is utilized to establish a connection with the shoe. By increasing an overall length of the footwear worn on the healthy limb, a speed of motion of the healthy limb may be reduced in order to increase weight bearing on the unhealthy limb. The restraining mechanism, which is preferably integrated into a bottom surface of the base section, may also be used to reduce the speed of motion of the healthy limb.

16 Claims, 15 Drawing Sheets

(51) Int. Cl.

| | |
|---|---|
| ***A43B 3/12*** | (2006.01) |
| ***A43B 1/10*** | (2006.01) |
| ***A43C 15/12*** | (2006.01) |
| ***A61H 3/00*** | (2006.01) |
| ***A43C 15/02*** | (2006.01) |
| ***A43B 13/22*** | (2006.01) |
| ***A43B 7/00*** | (2006.01) |

(52) U.S. Cl.

CPC ..... *A43B 7/00* (2013.01); *A43B 13/223* (2013.01); *A43C 15/02* (2013.01); *A43C 15/12* (2013.01); *A61H 3/00* (2013.01); *A61H 2003/007* (2013.01); *A61H 2201/164* (2013.01); *A61H 2201/165* (2013.01)

(56) References Cited

U.S. PATENT DOCUMENTS

| | | | | | |
|---|---|---|---|---|---|
| 2,075,229 | A | | 3/1937 | Rose | |
| 2,114,421 | A | * | 4/1938 | Giuffre | A43B 13/223 D2/916 |
| D135,339 | S | * | 3/1943 | Hansen | D2/919 |
| 4,118,878 | A | * | 10/1978 | Semon | A43B 13/223 36/8.1 |
| 4,177,583 | A | * | 12/1979 | Chapman | A43C 13/14 36/77 R |
| 4,387,515 | A | | 6/1983 | Baldwin | |
| 5,794,368 | A | * | 8/1998 | Kirby | A43B 5/185 36/135 |
| 7,310,894 | B1 | | 12/2007 | Schwarzman et al. | |
| 7,988,510 | B2 | | 8/2011 | Beltrani | |
| 9,295,302 | B1 | | 3/2016 | Reed et al. | |
| 2005/0268484 | A1 | * | 12/2005 | Dombowsky | A43B 13/187 36/11.5 |
| 2014/0223782 | A1 | | 8/2014 | Kuzirian | |
| 2017/0027803 | A1 | | 2/2017 | Agrawal et al. | |

OTHER PUBLICATIONS

"Waterproof Shoe Covers, Womdee Reusable Anti-Slip Overshoes, Washable Thickened Shoe Covers with Suction Cup Sole, 1 Pair-XXXXLarge", https://www.amazon.ca/Waterproof-Womdee-Anti-Slip-Overshoes-Pair-XXXXLarge/dp/B07LFFZHKK, Aug. 8, 2019, 4 pages.

"IStride™ Device", Moterum Technologies, https://moterum.com/products/istride-device/, Jan. 19, 2019-Jul. 14, 2019, 3 pages.

S P Murali Babu, et al., "Soft Sucker Shoe for Anti-Slippage Application", IEEE International Conference on Soft Robotics (Robosoft), Apr. 24-28, 2018, pp. 491-496.

"Anatomy of the Shoe", Shoe Guide, https://www.shoeguide.org/shoe_anatomy/, Feb. 20, 2019, 11 pages.

* cited by examiner

SHOE EXTENSION FOR PATIENT GAIT MODIFICATION

BACKGROUND

Field of the Invention

The present disclosure relates to medical rehabilitation devices. More specifically, the present disclosure describes a shoe extension or shoe enhancement that may be used for gait modification.

Description of the Related Art

Neuromotor and musculoskeletal impairments generally lead to asymmetry in walking patterns, which may reduce the walking capabilities of a patient and may cause skeletal deformities. As a result, the ability to perform activities of daily living may reduce, the risk of fall may increase, and the overall quality of life may be impacted. See Perry, J., M. Garrett, J. K. Gronley, and S. J. Mulroy. 1995. "Classification of Walking Handicap in the Stroke Population." *Stroke* 26 (6): 982-89, incorporated herein by reference in its entirety.

Strokes in adults and cerebral palsy in children are some of the medical conditions that may lead to asymmetry in gait patterns and motor impairment. In the United States, stroke is a leading cause of disability and death. As a result of the asymmetry in gait patterns, individuals suffering from neuromotor impairments may have an increased dependence on the healthy side of the body. For example, if neuromotor impairments affect the right leg of an individual, the dependence on left leg increases with time due to the asymmetry in gait patterns. Gait cycle parameters such as walking velocity, cadence, and step length may be affected with asymmetry in gait patterns, and the risk of fall may also increase. See De Quervain, I. A., S. R. Simon, S. Leurgans, W. S. Pease, and D. McAllister. 1996. "Gait Pattern in the Early Recovery Period after Stroke." *The Journal of Bone and Joint Surgery. American Volume* 78 (10): 1506-14; and Callisaya, Michele L., Leigh Blizzard, Michael D. Schmidt, Kara L. Martin, Jennifer L. McGinley, Lauren M. Sanders, and Velandai K. Srikanth. 2011. "Gait, Gait Variability and the Risk of Multiple Incident Falls in Older People: A Population-Based Study." Age and Ageing 40 (4): 481-87. https://doi.org/10.1093/ageing/afr055, each incorporated herein by reference in their entirety.

Different techniques have been implemented to improve walking in individuals affected with gait pattern asymmetry. A majority of the existing techniques are applied on the unhealthy limb. In a traditional rehabilitation approach, when task-oriented training is conducted, verbal instructions are provided to the patient to adjust their walking pattern/rhythm so that gait parameters, such as cadence and step length, are modified to perform a functional task exercise repeatedly. See Langhorne, Peter, Julie Bernhardt, and Gert Kwakkel. 2011. "Stroke Rehabilitation." *Lancet* (London, England) 377 (9778): 1693-1702. https://doi.org/10.1016/S0140-6736(11)60325-5; and Richards, C. L., F. Malouin, S. Wood-Dauphinee, J. I. Williams, J. P. Bouchard, and D. Brunet. 1993. "Task-Specific Physical Therapy for Optimization of Gait Recovery in Acute Stroke Patients." *Archives of Physical Medicine and Rehabilitation* 74 (6): 612-20, each incorporated herein by reference in their entirety.

In a different approach, an auditory feedback system, such as a metronome, is used to prompt the patient to walk while following a predefined tone. In another approach, split treadmills may be used to improve gait pattern and reduce asymmetry. Split treadmills utilize two separate belts that are operated with corresponding engines. Therefore, the belts of the split treadmill may be used to alter gait parameters of both limbs simultaneously. See Choi, Julia T., and Amy J. Bastian. 2007. "Adaptation Reveals Independent Control Networks for Human Walking." *Nature Neuroscience* 10 (8): 1055-62. https://doi.org/10.1038/nn1930; Yokoyama, Hikaru, Koji Sato, Tetsuya Ogawa, Shin-Ichiro Yamamoto, Kimitaka Nakazawa, and Noritaka Kawashima. 2018. "Characteristics of the Gait Adaptation Process Due to Split-Belt Treadmill Walking under a Wide Range of Right-Left Speed Ratios in Humans." *PloS One* 13 (4): e0194875. https://doi.org/10.1371/journal.pone.0194875; and Reisman, Darcy S., Hannah J. Block, and Amy J. Bastian. 2005. "Interlimb Coordination during Locomotion: What Can Be Adapted and Stored?" *Journal of Neurophysiology* 94 (4): 2403-15. https://doi.org/10.1152/jn.00089.2005, each incorporated herein by reference in their entirety.

In view of the drawbacks of the existing gait modification systems and methods, where only the unhealthy limb is targeted to improve gait patterns, the system and method of the present disclosure targets the healthy limb to improve gait patterns. More specifically, the present disclosure describes a wearable shoe extension or shoe enhancement that may be worn on the healthy limb to reduce asymmetry of the step length and reduce the time on the least affected/healthy limb. By utilizing the device of the present disclosure in training, a patient with gait pattern asymmetry is encouraged to adjust their walking pattern such that the unhealthy limb is strengthened through increased weight bearing. Different mechanisms may be implemented to adjust the difficulty level applied to the least affected/healthy limb.

SUMMARY OF THE INVENTION

The present disclosure describes a shoe extension that may be used for gait modification. The shoe extension is utilized with a shoe worn on a healthy limb of a patient with gait asymmetry. By wearing the shoe extension on the healthy limb, resistance is introduced to the healthy limb such that the overall speed of motion of the healthy limb may be reduced. Thus, the patient may be prompted to adjust a walking pattern by applying weight on the unhealthy limb. The weight applied on the unhealthy limb may vary with the resistance applied to the healthy limb through the shoe extension. In particular, with an increase in the resistance applied to the healthy limb, the weight applied on the unhealthy limb may also increase. The unhealthy limb may be strengthened by gradually increasing the weight applied on the unhealthy limb.

The shoe extension described in the present disclosure includes a vamp section, a base section, an attachment strap, and a restraining mechanism. The vamp section is terminally connected to a top surface of the base section. When the shoe extension is used on the healthy limb, a toe box of the shoe worn on the healthy limb is positioned into a receiving slot formed by the vamp section. Moreover, when the toe box is positioned into the receiving slot, the base section is positioned along an outsole of the shoe. The shoe extension described in the present disclosure is held against the shoe using the attachment strap which is preferably positioned over a collar of the shoe. By using the shoe extension on the healthy limb, a length of the footwear increases such that the length of the footwear worn on the healthy limb is greater than a length of the footwear worn on the unhealthy limb. As a result of the length difference, a speed of motion of the healthy limb may reduce. By delaying the motion of the healthy limb, additional weight may be applied on the unhealthy limb for strengthening purposes.

In addition to the vamp section, the restraining mechanism may also be used to restrict movement of the healthy limb. To do so, the restraining mechanism is preferably integrated to a bottom surface of the base section. In one aspect, the restraining mechanism may be a plurality of suction cups that is distributed along the bottom surface. A distribution pattern of the plurality of suction cups and a size of each of the plurality of suction cups may vary in order to adjust the resistance applied on the healthy limb. In another aspect, the restraining mechanism may be a pressure-sensitive adhesive layer that is coated on the bottom surface. A thickness of the pressure-sensitive adhesive layer and a distribution of the pressure-sensitive adhesive layer may also vary to adjust the resistance applied on the healthy limb.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

All illustrations of the drawings are for the purpose of describing selected embodiments of the present disclosure and are not intended to limit the scope of the present disclosure or accompanying claims.

The present disclosure describes a shoe extension that may be used for modifying gait patterns in patients with asymmetrical gait patterns. The shoe extension is used on a healthy limb of a patient, and may be used to improve the strength of an unhealthy limb. In particular, the shoe extension of the present disclosure reduces a speed of motion of the healthy limb or otherwise encumbers the healthy limb such that the unhealthy limb is strengthened by increased weight bearing. Furthermore, the shoe extension may reduce a probability of trip and fall, reduce secondary postural deviations, and improve body image and dual task cognitive skills.

Figure 1:
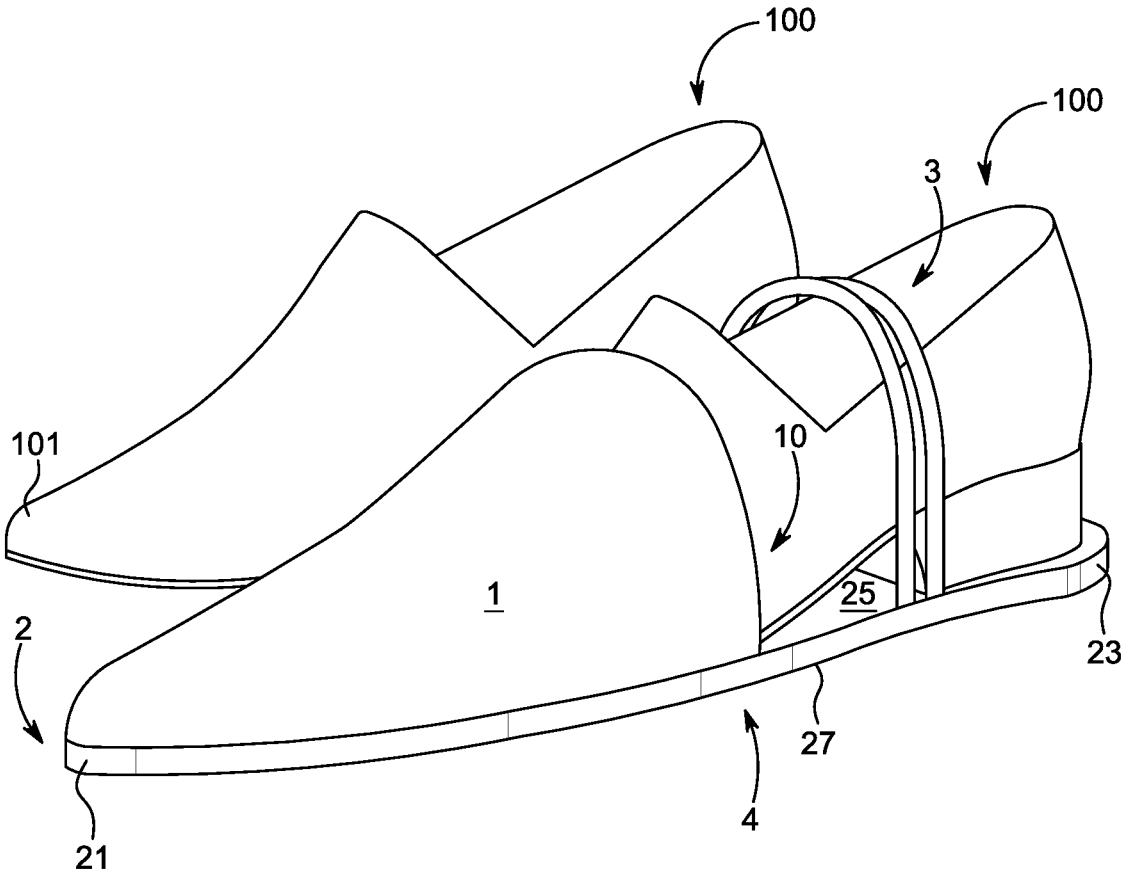
FIG. 1 illustrates the shoe extension described in the present disclosure being used with a first shoe from a pair of shoes, wherein a second shoe from the pair of shoes is illustrated without the shoe extension described in the present disclosure.

As seen in FIG. 1, the shoe extension of the present disclosure comprises a vamp section 1, a base section 2, and an attachment strap 3. To modify gait pattern asymmetry, the shoe extension of the present disclosure is worn on a healthy limb such that a speed of motion of the healthy limb is reduced during walking. In reference to FIG. 1, to reduce the speed of motion of the healthy limb, a toe box 101 of a shoe 100 worn on the healthy limb is slidably positioned into a receiving slot 10 formed by the vamp section 1. Thus, as seen in FIG. 1, an overall length of the shoe 100 worn on the healthy limb is increased. The length difference between a length of the shoe worn on the healthy limb and a length of the shoe worn on the unhealthy limb may result in reducing the speed of motion of the healthy limb.

Figure 2A:
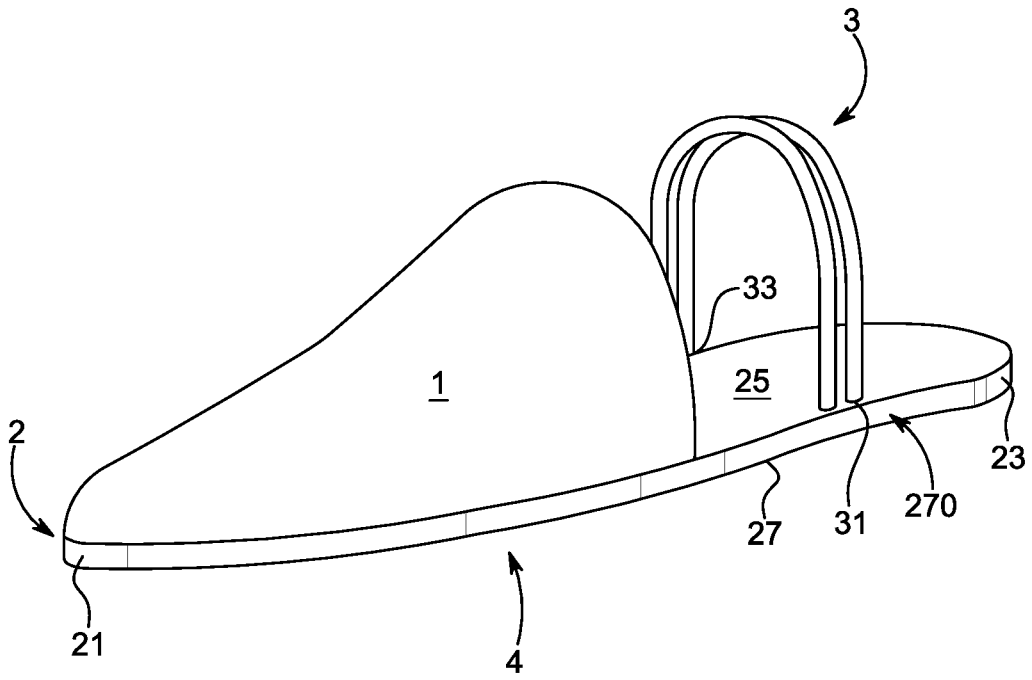
FIG. 2A is a perspective view of the shoe extension described in the present disclosure.
Figure 2B:
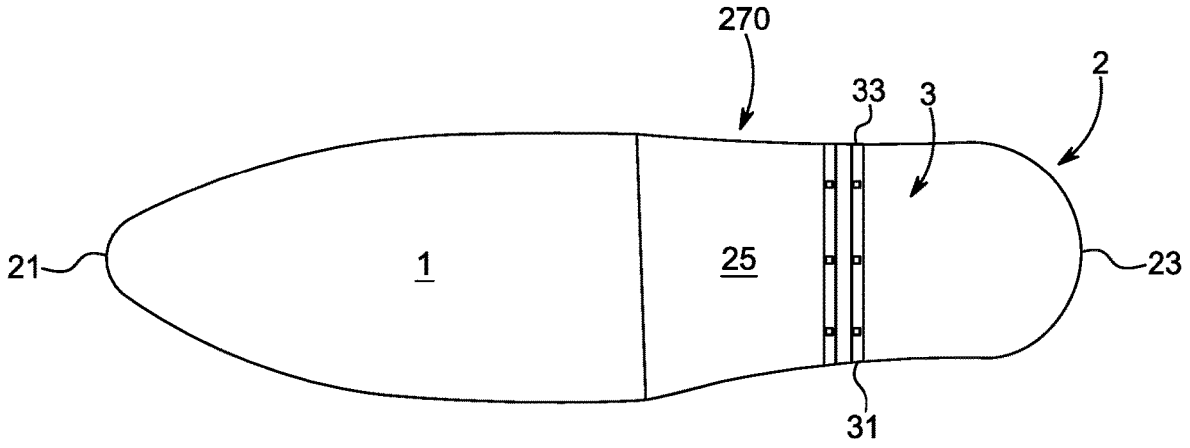
FIG. 2B is a top view of the shoe extension described in the present disclosure.
Figure 2C:
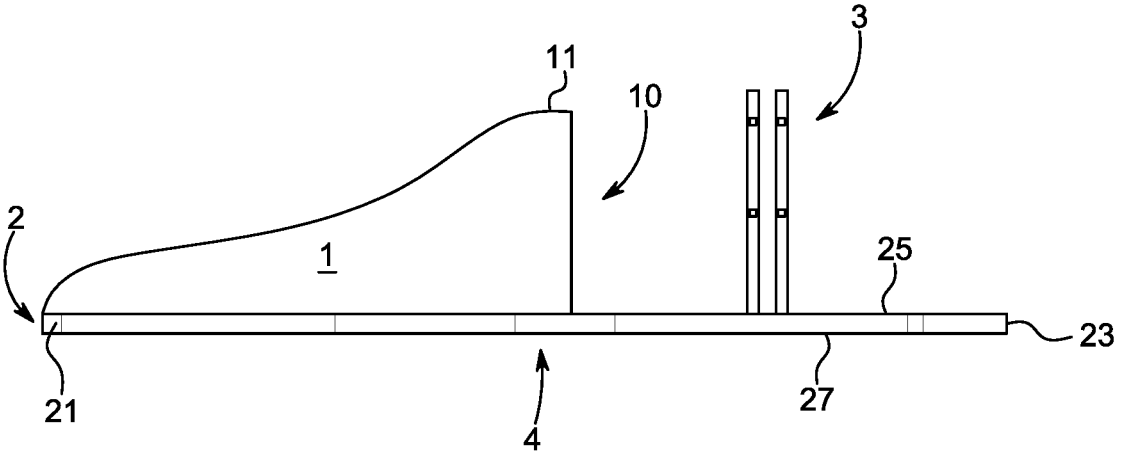
FIG. 2C is a side view of the shoe extension described in the present disclosure.
Figure 2D:
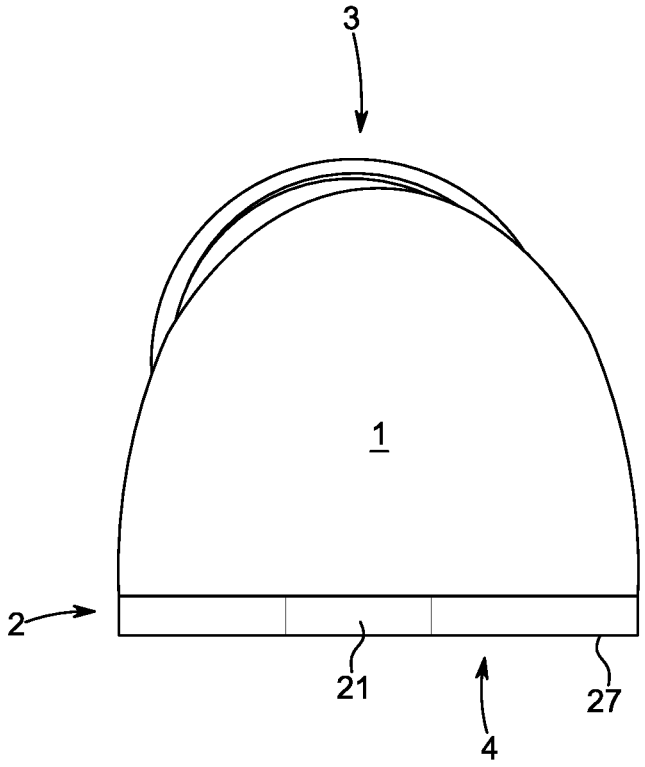
FIG. 2D is a front view of the shoe extension described in the present disclosure.

As seen in FIG. 1, when the toe box 101 of the shoe 100 is slidably positioned into the receiving slot 10, the base section 2 is positioned along an outsole of the shoe 100. To position the toe box 101 into the receiving slot 10 and position the base section 2 along the outsole as in FIG. 1, the vamp section 1 is connected to a top surface 25 of the base section 2 adjacent a first end 21 of the base section 2. Referring to FIG. 2C, a height between the top surface 25 and a peak point 11 of the receiving slot 10 may be, but is not limited to, a height within a range of 0.5 inches-2 inches, 0.5 inches-1.75 inches, and 1 inch-1.5 inches. Preferably, when the toe box 101 of the shoe 100 is positioned into the receiving slot 10 as shown in FIG. 1, a distance from the toe box 101 to the first end 21 may be within a range of 0.5 inches-8 inches, 0.75 inches-6 inches, with a preferable distance of 1 inch-5 inches. However, the length from the toe box 101 of the shoe 100, shown in FIG. 1, to the first end 21 may vary according to the gait asymmetry of the patient. The vamp section 1 may be manufactured from a material that may be, but is not limited to, leather and rubber. The vamp section is preferably 1.5 times the original length of the foot and made of hard plastic or wood. Preferably the vamp section is 1.1×, preferably 1.2×, 1.3×, 1.4× or 1.5× the length of the flat portion of the sole that is on contact with the ground when in a standing resting posture. The vamp is preferably a rigid plastic material, most preferably polycarbonate or polyphenylene sulfide.

As shown in FIG. 1, when the toe box 101 of the shoe is inserted into the receiving slot 10, the base section 2 is positioned along the outsole of the shoe 1. Therefore, during walking, a bottom surface 27 of the base section 2 contacts a walking surface similar to an outsole. In reference to FIG. 2B, the base section 2 extends from the first end 21 to a second end 23 of the base section 2. A length and a width of the base section 2, shown in FIGS. 1-3E, may vary according to a shoe size of the patient. The base section 2, shown in FIGS. 1-3E, may be manufactured from a material which can be, but is not limited to, leather, rubber, polyurethane, or a polyvinyl chloride (PVC) compound. A type of the PVC compound used for the base section 2 of FIGS. 1-3E may be, but is not limited to, DANVIL® SVA 3191, DANVIL® SVA 3103, DANVIL® SVA 3104, DANVIL® SVA 3105, DANVIL® SSO 3201, DANVIL® SSO 3203, DANVIL® SSE 3309, DANVIL® SSE 3310, DANVIL® SSE 3327, and DANVIL® SSE 3325. Preferably, the base section 2 of FIGS. 1-3E is manufactured to satisfy standards that may be, but is not limited to, ISO 20865:2002—testing method to determine the compression energy of outsoles, ISO 20871:2018—method of determining abrasion resistance for outsoles, ISO 20872:2018—method of determining a tear strength of outsoles, ISO 20873:2018—method of determining dimensional stability, and ISO 20874:2018—method of determining needle tear strength for outsoles.

Figure 5:
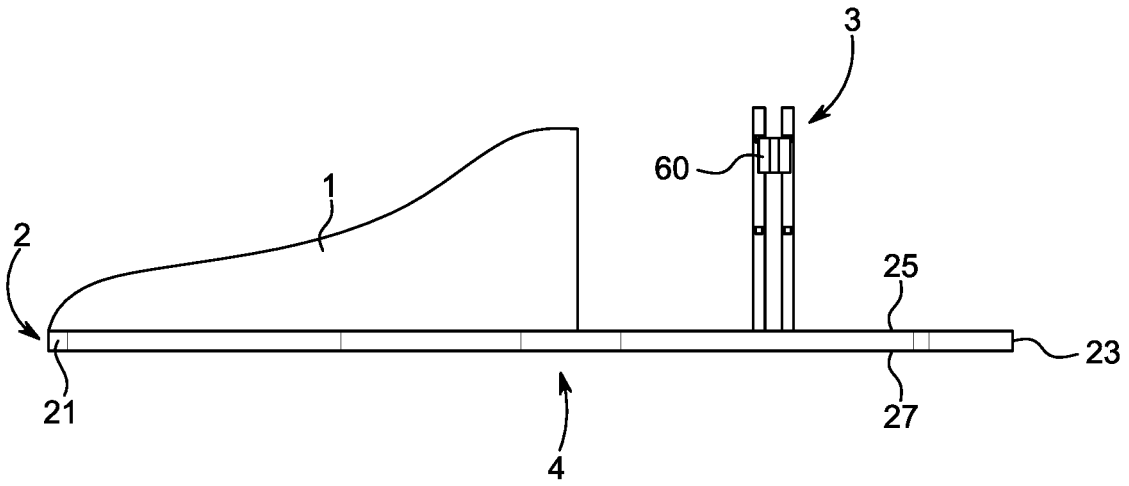
FIG. 5 is a side view of the shoe extension described in the present disclosure, wherein a fastening mechanism is integrated into an attachment strap, wherein the attachment strap is used to hold the shoe extension against the shoe.

As further illustrated in FIG. 1, the shoe extension of the present disclosure is removably attached to the shoe 100 with the attachment strap 3. As seen in FIG. 1, in a preferred embodiment, the attachment strap 3 includes a pair of elastic bands, however, in other embodiments, the attachment strap 3 may be structured differently. As seen in FIG. 2A and FIG. 2B, a first end 31 of the attachment strap 3 is terminally connected to a perimeter 270 of the base section 1 adjacent a second end 23 of the base section 2. As seen in FIG. 2B, a second end 33 of the attachment strap 3 is terminally connected to a perimeter 270 of the base section 2 adjacent the second end 23. In particular, as seen in FIG. 2B, the attachment strap 3 is connected to the base section 2 such that a first end 31 and a second end 33 of the attachment strap 3 are positioned opposite to each other across the top surface 25 of the base section 2. Moreover, as seen in FIG. 2A, the first end 31 and the second end 33 are connected to the top surface 25 forming a semi-circular loop above the top surface 25. Preferably, the attachment strap 3, shown in FIGS. 2A-2D, is elastic and/or is length-adjustable to be positioned around a collar of the shoe as illustrated in FIG. 1. To securely hold the attachment strap 3 against the shoe worn on the healthy limb, as illustrated in FIG. 5, a fastening mechanism 60 may be integrated into the attachment strap 3 in a different embodiment, wherein the fastening mechanism 60 may be, but is not limited to, a buckle.

As shown in FIG. 1, FIG. 2A, and FIGS. 2C-5, in addition to the vamp section 1, a restraining mechanism 4 may be integrated to a bottom surface 27 of the base section 2 to restrict movement of the healthy limb. By integrating the restraining mechanism 4 to the bottom surface 27 of the base section 2, as shown in FIGS. 2C-5, the patient is prompted to increase the effort required to move the healthy limb. Thus, the speed of motion of the healthy limb may reduce, and the unhealthy limb may be strengthened with increased weight bearing.

In some embodiments of the invention the device includes a haptic feedback mechanism, pressure sensor, power supply (battery) and controller. A micro vibrator (e.g., mini vibration motor) and associated power supply are embedded in the base section 1 of the device. A pressure switch initiates a multistage haptic feedback that is expressed by the haptic feedback mechanism and felt by the wearer. The feedback is preferably in the form of vibrations that can vary in intensity or frequency in multiple stages. A first stage is triggered by a first pressure sensor which triggers the micro vibrator through the controller for a predetermined time.

The purpose of the haptic feedback is to encourage or train the wearer to bear more weight on the unhealthy limb. Vibrations or other mechanical disturbance provided by the haptic feedback mechanism initiates a feeling of discomfort in the healthy limb. The vibrations may vary in intensity or frequency in stages. In a first stage a relatively low vibration and energy modes are triggered encountered. As a wearer places greater weight on the device, a second pressure sensor initiates a second stage of vibration frequency or vibration intensity. A plurality of sequentially increasing vibratory energy and/or frequency is utilized such that the wearer places less weight on the healthy limb in favor of the unhealthy limb. The device preferably includes a controller that is programed with instructions to initiate and halt vibrations from the micro vibrator. The microcontroller may further include instructions for a timing or duration of vibration. For example, for an individual having a regular gait, the haptic device may be switched on at a pressure sensor set to trigger when the wearer is places about 50% of a maximum pressure encountered in a regular stride on the device. The microcontroller may initiate the vibrations from the device for a period of about 0.05, 0.1, 0.5, 1 or 2 seconds. As second and further stages of pressure are encountered, the microcontroller changes, preferably increases, the intensity or frequency of the haptic feedback for time periods such as 0.05, 0.1, 0.5, 1.0, 1.5 or 2 seconds.

In another embodiment, the upper surface of the base section (sole) of the device includes one or more protuberances that are preferably located in at the first end 31 or second end 23 of the device. In particular, a protuberances preferably has a length of approximately 1-3 or 1.5-2.5 inches, a width of 0.25 to 1 inches or 0.5 inches, and a height of from 0.1 to 0.5 inches, preferably 0.2-0.3 inches. The purpose of the protuberances is to provide feedback to the wearer. The protuberance is preferably located proximal to a front toe position or a heel position where it functions as a discomfort reminder and encourages or trains the wearer to bear more weight on the unhealthy limb.

The restraining mechanism 4, shown in FIG. 1, FIG. 2A, and FIGS. 2C-5, may vary in different embodiments. In a preferred embodiment, as seen in FIGS. 3A-3E, the restraining mechanism 4 comprises a plurality of suction cups 40, wherein the plurality of suction cups 40 is distributed along the bottom surface 27 of the base section 2. The shape of each of the plurality of suction cups 40 and the distribution of the plurality of suction cups 40 may vary according to the gait asymmetry of the patient. In particular, further referring to FIGS. 3A-3E, a resistance applied on the healthy limb may be adjusted by varying the shape of each of the plurality of suction cups 40 and/or by varying the distribution of the plurality of suction cups 40.

As seen in FIGS. 3A-3E, in a preferred embodiment, each of the plurality of suction cups 40 is circular in shape. However, in other embodiments, each of the plurality of suction cups 40, shown in FIGS. 3A-3E, may be shaped differently. For example, each of the plurality of suction cups 40 may be oval-shaped in a different embodiment. In another embodiment, the plurality of suction cups 40 of FIGS. 3A-3E, may be a combination of circular suction cups and oval-shaped suction cups. In a preferred embodiment, a diameter of each of the plurality of suction cups 40 seen in FIGS. 3A-3E may be, but is not limited to, a diameter within a range of 5 millimeters (mm)-60 mm, 8 mm-55 mm, with a preferable range of 10 mm-50 mm.

Figure 3A:
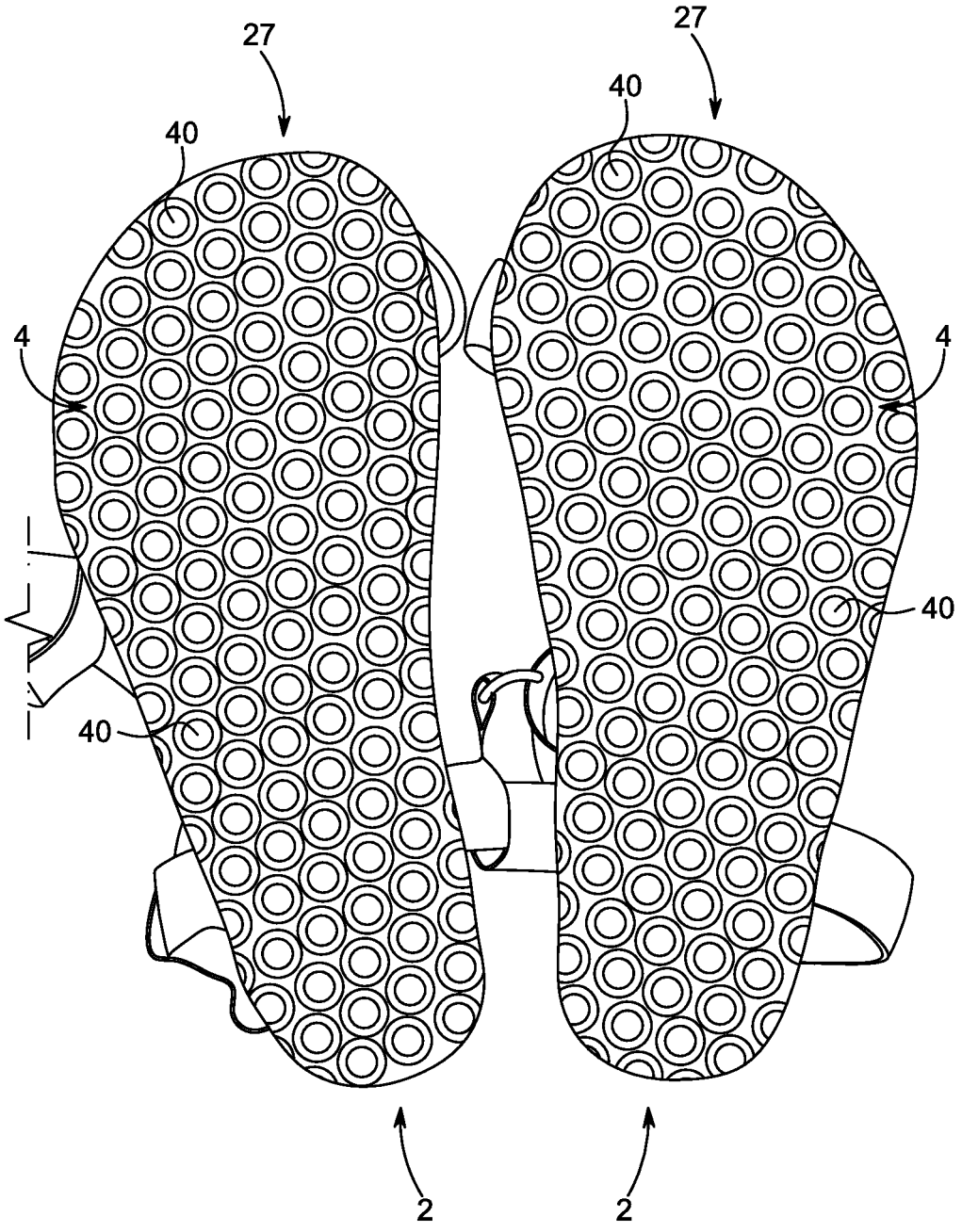
FIG. 3A illustrates a restraining mechanism that may be integrated to a bottom surface of the shoe extension, wherein a plurality of suction cups is distributed on the bottom surface.
Figure 3B:
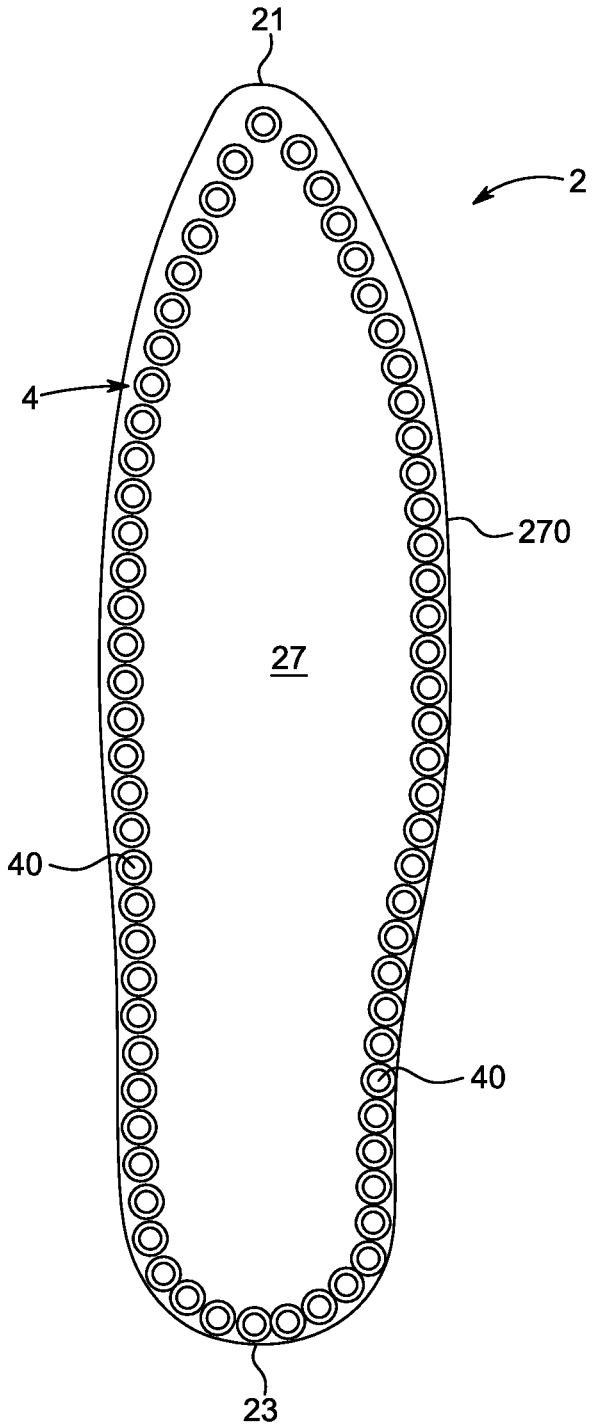
FIG. 3B is an illustration of the plurality of suction cups being distributed along a perimeter of the bottom surface.

As seen in FIG. 3B, in one embodiment, the plurality of suction cups 40 may be distributed along a perimeter 270 of the bottom surface 27. Preferably, each of the plurality of suctions cups 40 of FIG. 3B is equidistantly distributed along the perimeter 270. However, in a different embodiment, a distance between a first suction cup and a second suction cup may be different than a distance between the second suction cup and a third suction cup, wherein the first suction cup, the second suction cup, and the third suction cup are from the plurality of suction cups 40 shown in FIG. 3B.

Figure 3C:
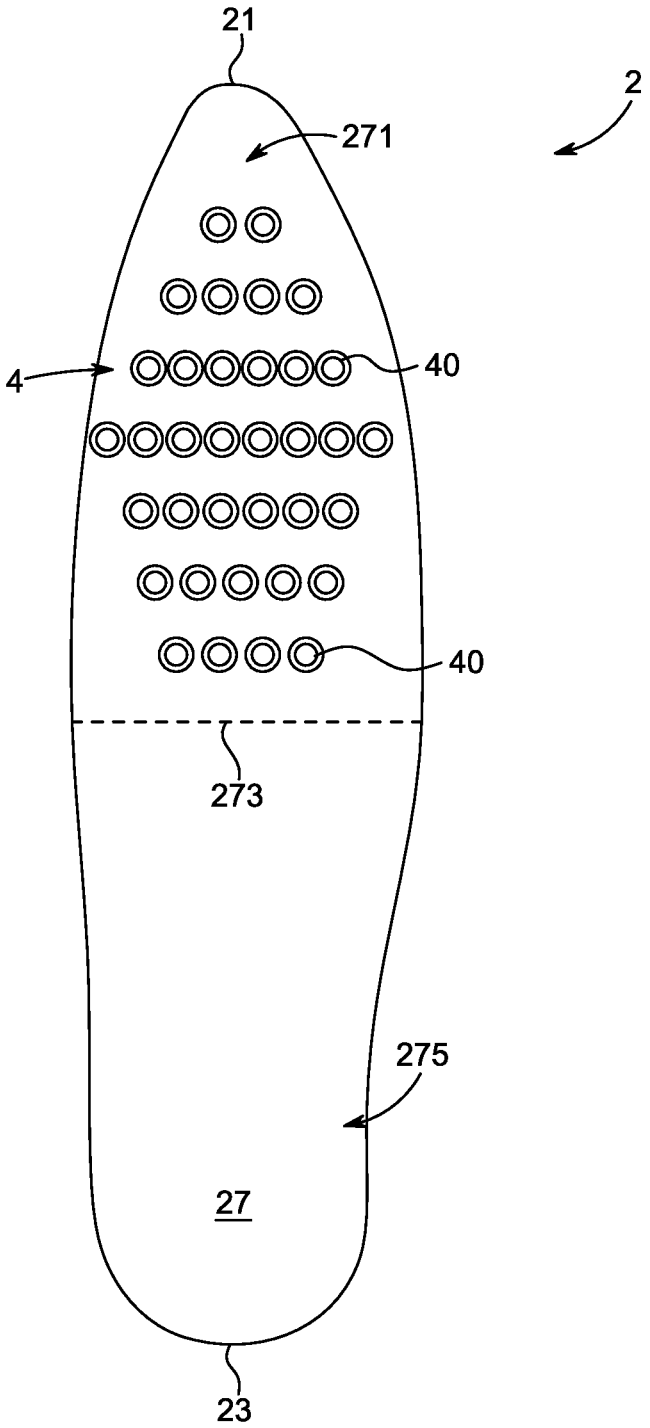
FIG. 3C is an illustration of the plurality of suction cups being distributed on a front section of the bottom surface.

As seen in FIG. 3C, depending on the gait asymmetry of the patient, the plurality of suction cups 40 may be partially distributed on the bottom surface 27. For example, further referring to FIG. 3C, the plurality of suction cups 40 may be distributed on a front section 271 of the bottom surface 27, wherein the front section 271 is separated from a rear section 275 of the bottom surface 27 at a midpoint line 273. As seen in FIG. 3C, the front section 271 is positioned adjacent the first end 21 of the base section 2, and the rear section 275 is positioned adjacent the second end 23 of the base section 2. When the plurality of suction cups 40 is distributed on the front section 271, as seen in FIG. 3C, resistance is applied to the healthy limb when the front section 271 is in contact with a walking surface.

Figure 3D:
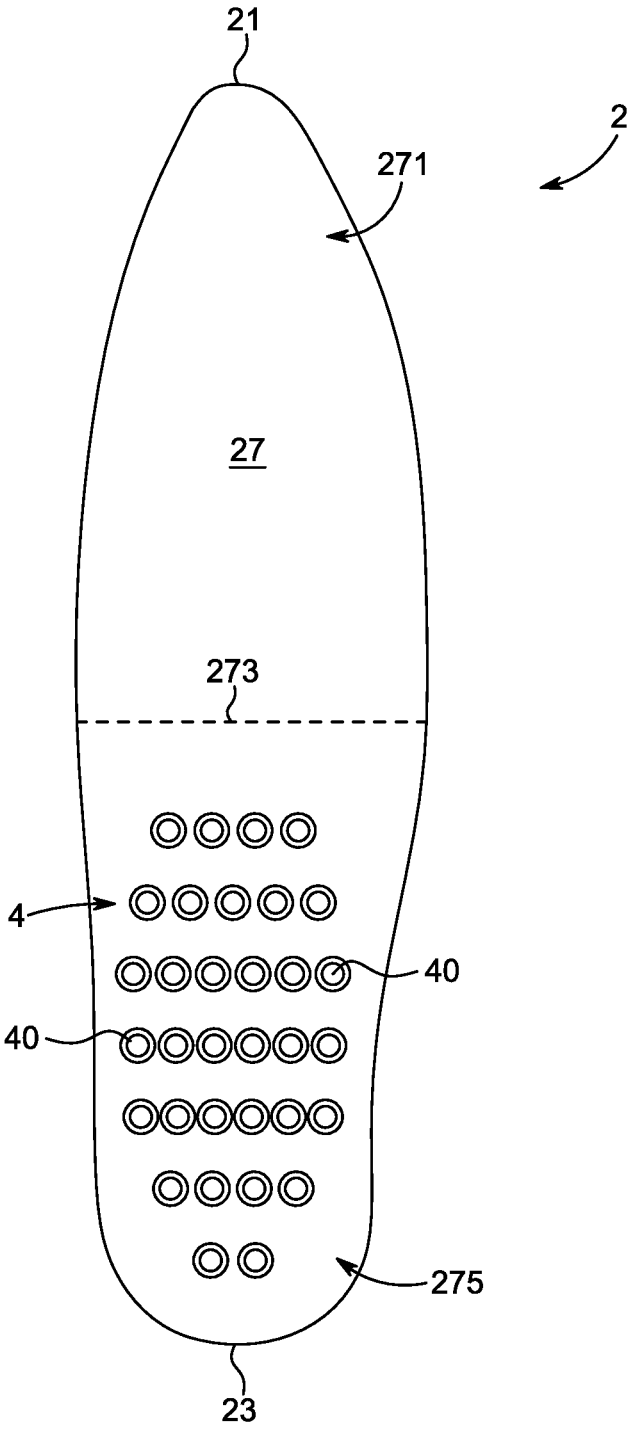
FIG. 3D is an illustration of the plurality of suction cups being distributed on a rear section of the bottom surface.

As seen in FIG. 3D, in a different embodiment, depending on the gait asymmetry of the patient, the plurality of suction cups 40 may be partially distributed on the rear section 275 of the bottom surface 27. As seen in FIG. 3D, when the plurality of suction cups 40 is distributed on the rear section 275, resistance is applied to the healthy limb when the rear section 275 is in contact with the walking surface.

Figure 3E:
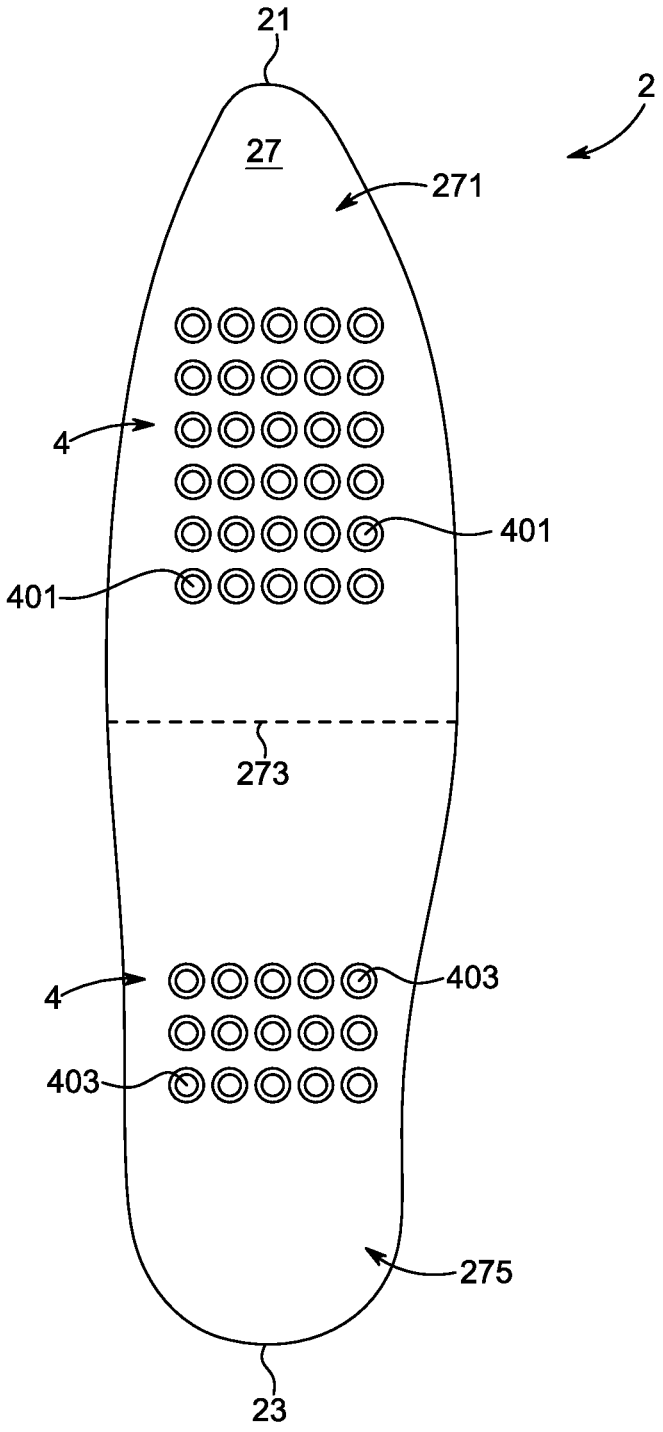
FIG. 3E is an illustration of a first portion of the plurality of suction cups being distributed on the front section and a second portion of the plurality of suction cups being distributed on the rear section, wherein a ratio between the first portion and the second portion is 2:1.

In reference to FIG. 3E, in a different embodiment, the plurality of suction cups 40 may be proportionately distributed on the front section 271 and the rear section 275. As seen in FIG. 3E, a first portion 401 of the plurality of suction cups 40 may be distributed on the front section 271, and a second portion 403 of the plurality of suction cups 40 may be distributed on the rear section 275. A ratio between the first portion 401 and the second portion 403, shown in FIG. 3E, may vary according to the gait asymmetry of the patient. For example, in one embodiment, the ratio between the first portion 401 and the second portion 403 may be 1:1. In another embodiment, as seen in FIG. 3E, the ratio between the first portion 401 and the second portion 403 may be 2:1. In a different embodiment, the ratio between the first portion 401 and the second portion 403 may be 1:2.

The restraining mechanism 4, shown in FIG. 1, FIG. 2A, and FIGS. 2C-5, integrated to the bottom surface 27 of the base section 2 may vary in different embodiments. As seen in FIG. 4A and FIG. 4B, in a different embodiment, the restraining mechanism 4 may be a pressure-sensitive adhesive layer 5 that is coated across the bottom surface 27 of the base section 2. By using the pressure-sensitive adhesive layer 5, as shown in FIG. 4B, the bottom surface 27 may repeatedly stick and unstick to the walking surface. Generally, when a pressure-sensitive adhesive is used, a strength of a bond between the pressure-sensitive adhesive and an external surface depends on the pressure applied to stick the pressure-sensitive adhesive to the external surface. Therefore, when the pressure-sensitive adhesive layer 5 is coated on the bottom surface 27 as shown in FIG. 4B, the bond between the pressure-sensitive adhesive layer 5 and the walking surface depends on the pressure applied by the patient. More specifically, when the weight of the patient applies pressure on the base section 2, the bottom surface 27 may stick to the walking surface. When the weight of the patient is removed to release pressure from the base section 2, the bottom surface 27 may unstick from the walking surface. The coating of the pressure-sensitive adhesive layer 5, shown in FIG. 4A and FIG. 4B, may be adjusted according to the gait asymmetry of the patient. As seen in FIG. 4C, in one embodiment, the pressure-sensitive adhesive layer 5 may be coated on the front section 271. As seen in FIG. 4D, in a different embodiment, the pressure-sensitive adhesive layer 5 may be coated on the rear section 275.

Figure 4A:
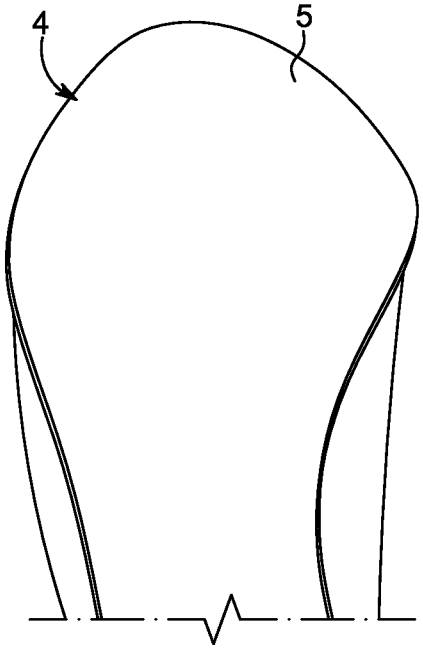
FIG. 4A illustrates a pressure-sensitive adhesive layer that may be used on a bottom surface of the shoe extension described in the present disclosure.
Figure 4B:
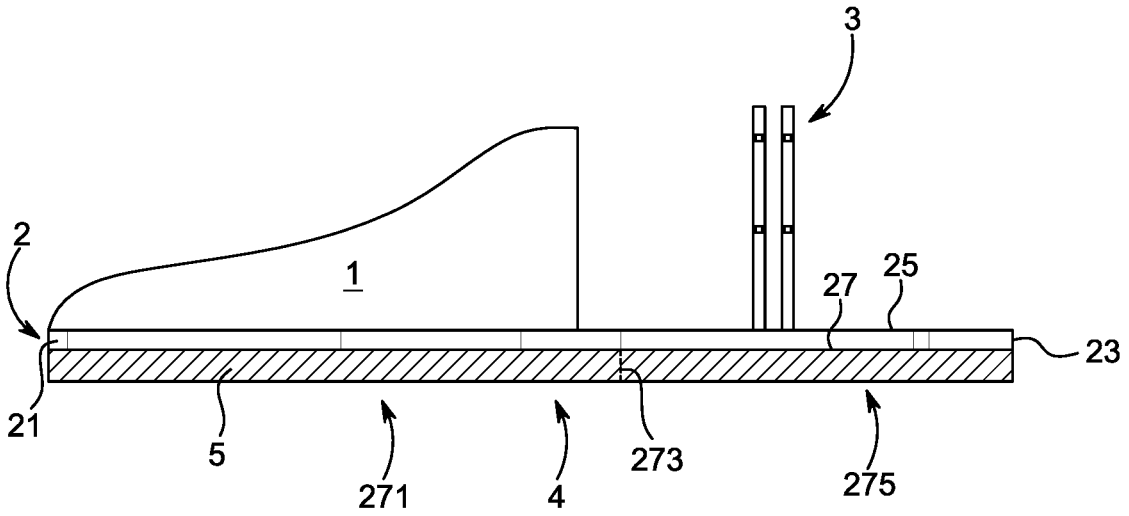
FIG. 4B is a side view of the shoe extension described in the present disclosure, wherein the pressure-sensitive adhesive layer is coated across the bottom surface of the base section.
Figure 4C:
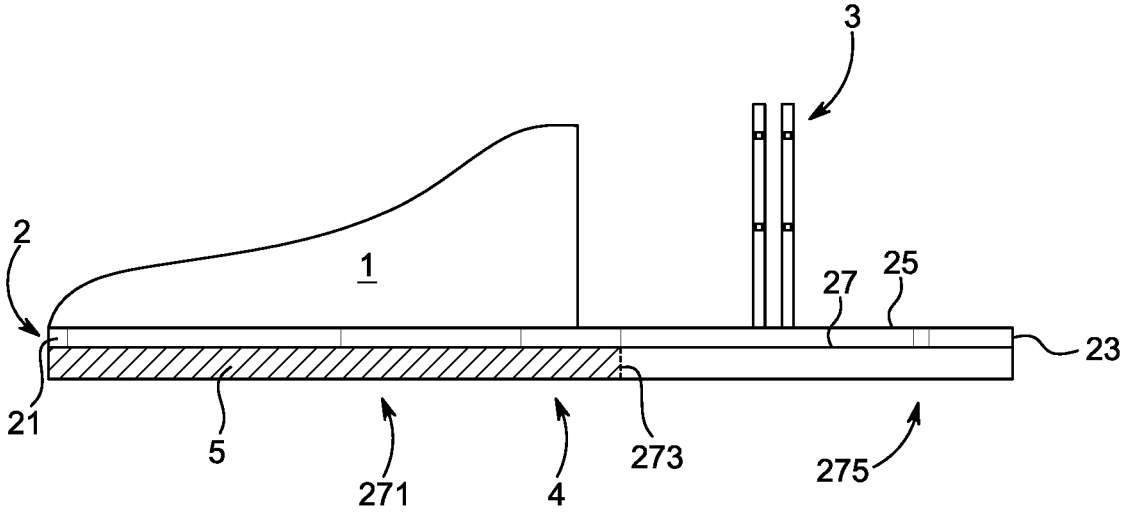
FIG. 4C is a side view of the shoe extension described in the present disclosure, wherein the pressure-sensitive adhesive layer is coated across the front section of the bottom surface.
Figure 4D:
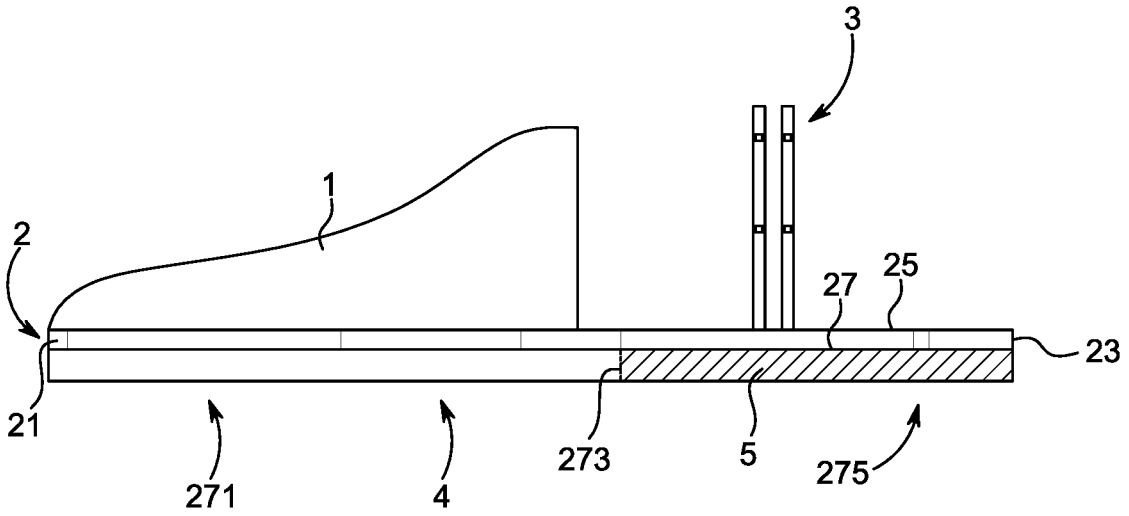
FIG. 4D is a side view of the shoe extension described in the present disclosure, wherein the pressure-sensitive adhesive layer is coated across the rear section of the bottom surface.

A thickness of the pressure-sensitive adhesive layer 5, shown in FIG. 4B, may vary according to the gait asymmetry of the patient. For example, in reference to FIG. 4B, a thickness of the pressure-sensitive adhesive layer 5 used for a patient with moderate gait asymmetry may be lesser than a thickness of the pressure-sensitive adhesive layer 5 used for a patient with severe gait asymmetry. In further reference to FIG. 4B, the thickness of the pressure-sensitive adhesive layer 5 may be, but is not limited to, a thickness within a range of 0.5 mm-5 mm, 0.75 mm-4 mm, with a preferable range of 1 mm-3 mm. Preferably, the pressure-sensitive adhesive layer 5 of FIGS. 4A-4D satisfies standards that may be, but is not limited to, ISO 29862:2018—determining peel adhesion properties and ISO 29863:2018—measuring of static shear adhesion. In one embodiment, the type of the pressure-sensitive adhesive layer 5 coated on the bottom surface 27, shown in FIG. 4A-4D, may be a rubber-based adhesive, wherein rubber-based adhesives provide shear strength and flexibility. In a different embodiment, the type of the pressure-sensitive adhesive layer 5 coated on the bottom surface 27, shown in FIG. 4A-4D, may be an acrylic-based adhesive, wherein acrylic-based adhesives have an operating temperature ranging from about −50 Celsius (° C.) to 150° C., −50° C. to 125° C., with a preferred range of −45° C. to 122° C. In a different embodiment, the type of the pressure-sensitive adhesive layer 5 coated on the bottom surface 27, shown in FIG. 4A-4D, may be a silicon-based adhesive, wherein silicon-based adhesives have an operating temperature ranging from −80° C. to 275° C., −75° C. to 265° C., with a preferred range of −73° C. to 260° C. The adhesive material preferably functions to slightly slowdown the good leg while walking. The adhesive is preferably applied to create a plurality of zones having different adhesive effect. For example, the adhesive layer is divided into 3, 4, 5, 6, or 8 zones on the bottom surface. Each zone represents an area defined as longitudinal strips across the long axis of the bottom surface. The strips preferably contain different amounts of adhesive material or different types of adhesive material such that the adhesive force increases zone by zone from the heel portion to the toe portion of the bottom surface. Preferably the adhesion increases in regular intervals across the zones such that the last zone has an adhesion that is 1.5×, 2×, 2.5× or 3× the adhesion of the first zone at the heel portion. For example, the adhesion may increase 20% from zone to zone providing a bottom surface with 5 zones the last of which has 100% more adhesion than the first zone. Similar effects can be achieved with zone to zone adhesion increases of 25%, 30%, 40%, or 50%. Adhesion is preferably measured using ASTM D5179-16.

In another embodiment the lower layer of the shoe on the healthy leg will have a thin sheet of a permanent magnet with a certain polarity (e.g., + or −) and the patient walks on a long plastic sheet that has isolated wires powered by 12 volt DC and an adjustable current source to provide a magnetic field with a polarity that is opposite to the polarity in the shoe to ensure that both magnets would attract to reduce the speed of the health leg while the patient walks on the plastic sheet.

Terminology used herein is for the purpose of describing particular embodiments only and is not intended to be limiting of the invention.

As used herein, the singular forms "a", "an" and "the" are intended to include the plural forms as well, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

As used herein, the term "and/or" includes any and all combinations of one or more of the associated listed items and may be abbreviated as "/".

As used herein in the specification and claims, including as used in the examples and unless otherwise expressly specified, all numbers may be read as if prefaced by the word "substantially", "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), +/−20% of the stated value (or range of values), etc. Any numerical range recited herein is intended to include all subranges subsumed therein.

Disclosure of values and ranges of values for specific parameters (such as temperatures, molecular weights, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10 it also describes subranges for Parameter X including 1-9, 1-8, 1-7, 2-9, 2-8, 2-7, 3-9, 3-8, 3-7, 2-8, 3-7, 4-6, or 7-10, 8-10 or 9-10 as mere examples. A range encompasses its endpoints as well as values inside of an endpoint, for example, the range 0-5 includes 0, >0, 1, 2, 3, 4, <5 and 5.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

All publications and patent applications mentioned in this specification are herein incorporated by reference in their entirety to the same extent as if each individual publication or patent application was specifically and individually indicated to be incorporated by reference, especially referenced is disclosure appearing in the same sentence, paragraph, page or section of the specification in which the incorporation by reference appears.

Obviously, numerous modifications and variations of the present invention are possible in light of the above teachings. It is therefore to be understood that within the scope of the appended claims, the invention may be practiced otherwise than as specifically described herein.

The invention claimed is:

1. A shoe extension for gait pattern modification, comprising:

a vamp section;

a base section, wherein the base section comprises a first end, a second end, and a midpoint line about halfway between the first and second ends;

wherein a perimeter, a top surface and a bottom surface of the base section at the terminus of the second end are exposed;

wherein the base section is configured so that a first end of a toe box of a shoe is slidably positioned into a receiving slot at the first end and a heel end of the shoe is exposed at the second end;

the vamp section being connected to the top surface of the perimeter of the base section adjacent the first end;

wherein the vamp section does not extend past the midpoint line of the base section;

wherein the vamp section is continuously connected around the top surface of the perimeter of the first end of the base section so as to form the receiving slot;

wherein the vamp section is configured so that the first end of the toe box of the shoe is slidably positioned into the receiving slot;

wherein the first end of the toe box is enclosed by the vamp section;

a pair of attachment straps, wherein a first end of a first attachment strap and a first end of a second attachment strap is are terminally connected to the perimeter of the base section adjacent the second end of the base section, wherein a second end of the first attachment strap and a second end of the second attachment strap is are terminally connected to the perimeter of the base section adjacent the second end of the base section, wherein the first end and the second end of the attachment straps are positioned opposite to each other across the top surface of the base section so that the pair of attachment straps extend perpendicularly from the base section;

wherein the pair of attachment straps are elastic bands of the same length;

wherein the elastic bands run parallel to each other and are separated by a gap;

wherein the pair of attachment straps are not directly connected to the vamp section; and a restraining mechanism, wherein the restraining mechanism is integrated to a bottom surface of the base section.

2. The shoe extension for gait pattern modification of claim 1, wherein the restraining mechanism comprises a plurality of suction cups; and the plurality of suction cups being distributed along the bottom surface of the base section.

3. The shoe extension for gait pattern modification of claim 2, wherein each of the plurality of suction cups is circular in shape.

4. The shoe extension for gait pattern modification of claim 2, wherein the plurality of suction cups is distributed along a perimeter of the bottom surface.

5. The shoe extension for gait pattern modification of claim 2, wherein the bottom surface comprises a front section and a rear section, wherein the front section is separated from the rear section at a midpoint line of the bottom surface, and wherein the plurality of suctions cups is distributed on the front section.

6. The shoe extension for gait pattern modification of claim 2, wherein the bottom surface comprises a front section and a rear section, wherein the front section is separated from the rear section at a midpoint line of the bottom surface; and wherein the plurality of suctions cups is distributed on the rear section.

7. The shoe extension for gait pattern modification of claim 2, wherein the bottom surface comprises a front section and a rear section, wherein the front section is separated from the rear section at a midpoint line of the bottom surface, wherein a first portion of the plurality of suction cups is distributed on the front section, wherein a second portion of the plurality of suction cups is distributed on the rear section, and wherein a ratio between the first portion and the second portion is 2:1.

8. The shoe extension for gait pattern modification of claim 2, wherein a diameter of a suction cup of the plurality of suction cups is within a range of 10 millimeters (mm)-50 mm.

9. The shoe extension for gait pattern modification of claim 1, wherein the restraining mechanism is a pressure-sensitive adhesive layer, and wherein the pressure-sensitive adhesive layer is coated across the bottom surface of the base section.

10. The shoe extension for gait pattern modification of claim 9, wherein the bottom surface comprises a front section and a rear section, wherein the front section is separated from the rear section at a midpoint line of the bottom surface, and wherein the pressure-sensitive adhesive layer is coated across the front section.

11. The shoe extension for gait pattern modification of claim 9, wherein the bottom surface comprises a front section and a rear section, wherein the front section is separated from the rear section at a midpoint line of the bottom surface, and wherein the pressure-sensitive adhesive layer is coated across the rear section.

12. The shoe extension for gait pattern modification of claim 9, wherein a thickness of the pressure-sensitive adhesive layer is within a range of 1 mm-3 mm.

13. The shoe extension for gait pattern modification of claim 1, wherein the base section is manufactured from leather.

14. The shoe extension for gait pattern modification of claim 1, wherein the base section is manufactured from rubber.

15. The shoe extension for gait pattern modification of claim 1, wherein the base section is manufactured from polyurethane.

16. The shoe extension for gait pattern modification of claim 1, wherein the base section is manufactured from a polyvinyl chloride (PVC) compound.

* * * * *